US010816217B2

(12) United States Patent
Hill et al.

(10) Patent No.: US 10,816,217 B2
(45) Date of Patent: Oct. 27, 2020

(54) OVEN APPLIANCE

(71) Applicant: Haier US Appliance Solutions, Inc., Wilmington, DE (US)

(72) Inventors: Leonard Seth Hill, Bryant, AL (US); Elvin Thomas Philip, LaFayette, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 316 days.

(21) Appl. No.: 15/880,596

(22) Filed: Jan. 26, 2018

(65) Prior Publication Data

US 2019/0234620 A1 Aug. 1, 2019

(51) Int. Cl.
*F24C 15/10* (2006.01)

(52) U.S. Cl.
CPC ..... *F24C 15/102* (2013.01); *F24C 15/108* (2013.01)

(58) Field of Classification Search
CPC .... F24C 15/108; F24C 15/103; F24C 15/102; A47B 77/06
USPC ..... 219/452.11, 453.11, 453.12, 453.13, 219/453.15; 126/1 R, 37 A, 37 R
See application file for complete search history.

(56) References Cited

U.S. PATENT DOCUMENTS

| | | | | |
|---|---|---|---|---|
| 5,215,074 | A * | 6/1993 | Wilson | F24C 15/10 126/211 |
| 5,611,609 | A * | 3/1997 | Katz | D06F 39/12 312/263 |
| 6,712,066 | B1 * | 3/2004 | Atkinson | F24C 7/082 126/211 |
| 9,447,978 | B2 | 9/2016 | Ruperee | |
| 9,521,708 | B2 * | 12/2016 | Adelmann | H05B 3/74 |
| 10,408,466 | B2 * | 9/2019 | Bayerlein | F24C 15/108 |
| 2011/0192391 | A1 | 8/2011 | Bevilacqua et al. | |

FOREIGN PATENT DOCUMENTS

| | | | |
|---|---|---|---|
| CN | 204091776 | U | 1/2015 |
| EP | 2097680 | B1 | 2/2016 |
| KR | 1020050087073 | B1 | 11/2006 |

* cited by examiner

*Primary Examiner* — Erin Deery
(74) *Attorney, Agent, or Firm* — Dority & Manning, P.A.

(57) ABSTRACT

An oven appliance includes a cabinet extending between a top portion and a bottom portion along a vertical direction and extending between a left side and a right side along a lateral direction. The vertical direction and the lateral direction are mutually perpendicular. The oven appliance also includes a maintop having a heating element positioned within the maintop. The maintop is fixedly mounted to the top portion of the cabinet. The maintop is constrained against movement along the lateral direction by a first emboss at the left side of the cabinet and a second emboss at the right side of the cabinet.

16 Claims, 7 Drawing Sheets

OVEN APPLIANCE

FIELD OF THE INVENTION

The present disclosure relates generally to oven appliances and methods of assembling oven appliances.

BACKGROUND OF THE INVENTION

Oven appliances generally include a cabinet having a top portion. A top panel, also referred to as a maintop, may be positioned on or over the top portion of the cabinet. Oven appliances typically include heating elements, e.g., electric heating elements or gas burners, for heating pots, pans, and other containers with food items therein. The heating elements are positioned within the maintop proximate to, e.g., below, a cooking surface of the maintop.

Assembly of such oven appliances typically includes connecting the maintop to the cabinet with hinge pins. The hinge pins are usually separate pieces fastened to the cabinet. As a result of the hinge pin connection, the maintop is pivotally connected to the cabinet, e.g., at a back splash or control panel of the cabinet. The maintop may be rotated up away from the cabinet in order to complete installation of the heating elements, e.g., making up wired connections between the electric heating elements and the control panel. During this procedure, the maintop must be propped up or otherwise held in place. After the wiring is complete, the maintop is rotated back into position on the cabinet and fastened to the cabinet.

Such conventional assembly processes require multiple parts and several steps which may be ergonomically challenging. Accordingly, an oven appliance with features for increased ease of assembly and reduced part count would be useful.

BRIEF DESCRIPTION OF THE INVENTION

The present invention provides a maintop of an oven appliance whereby the oven appliance may be assembled by sliding the maintop onto a cabinet of the oven appliance. A first emboss at a first side of the cabinet constrains the maintop against side-to-side movement in a first direction and a second emboss at a second side of the cabinet, the second side opposite the first side constrains the cabinet against side-to-side movement in a second direction opposing the first direction. Accordingly, the first and second emboss help align the maintop with the cabinet during assembly of the oven appliance and constrain the maintop against side-to-side, e.g., lateral, movement when the oven appliance is fully assembled. Additional aspects and advantages of the invention will be set forth in part in the following description, or may be apparent from the description, or may be learned through practice of the invention.

In an exemplary aspect of the present disclosure, an oven appliance is provided. The oven appliance defines a lateral direction, a transverse direction, and a vertical direction. The lateral direction, the transverse direction, and the vertical direction are mutually perpendicular. The oven appliance includes a cabinet extending between a top portion and a bottom portion along the vertical direction, between a left side and a right side along the lateral direction, and between a front portion and a back portion along the transverse direction. A first brace is mounted to the cabinet at the top portion of the cabinet and extends along the left side of the cabinet between the front portion of the cabinet and the back portion of the cabinet. A second brace is mounted to the cabinet at the top portion of the cabinet and extends along the right side of the cabinet between the front portion of the cabinet and the back portion of the cabinet. The oven appliance also includes a maintop fixedly mounted on the top portion of the cabinet. The maintop is constrained against movement along the lateral direction towards the right side of the cabinet by the first brace and constrained against movement along the lateral direction towards the left side of the cabinet by the second brace.

In another exemplary aspect of the present disclosure an oven appliance is provided. The oven appliance includes a cabinet extending between a top portion and a bottom portion along a vertical direction and extending between a left side and a right side along a lateral direction. The vertical direction and the lateral direction are mutually perpendicular. The oven appliance also includes a maintop having a heating element positioned within the maintop. The maintop is fixedly mounted to the top portion of the cabinet. The maintop is constrained against movement along the lateral direction by a first emboss at the left side of the cabinet and a second emboss at the right side of the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
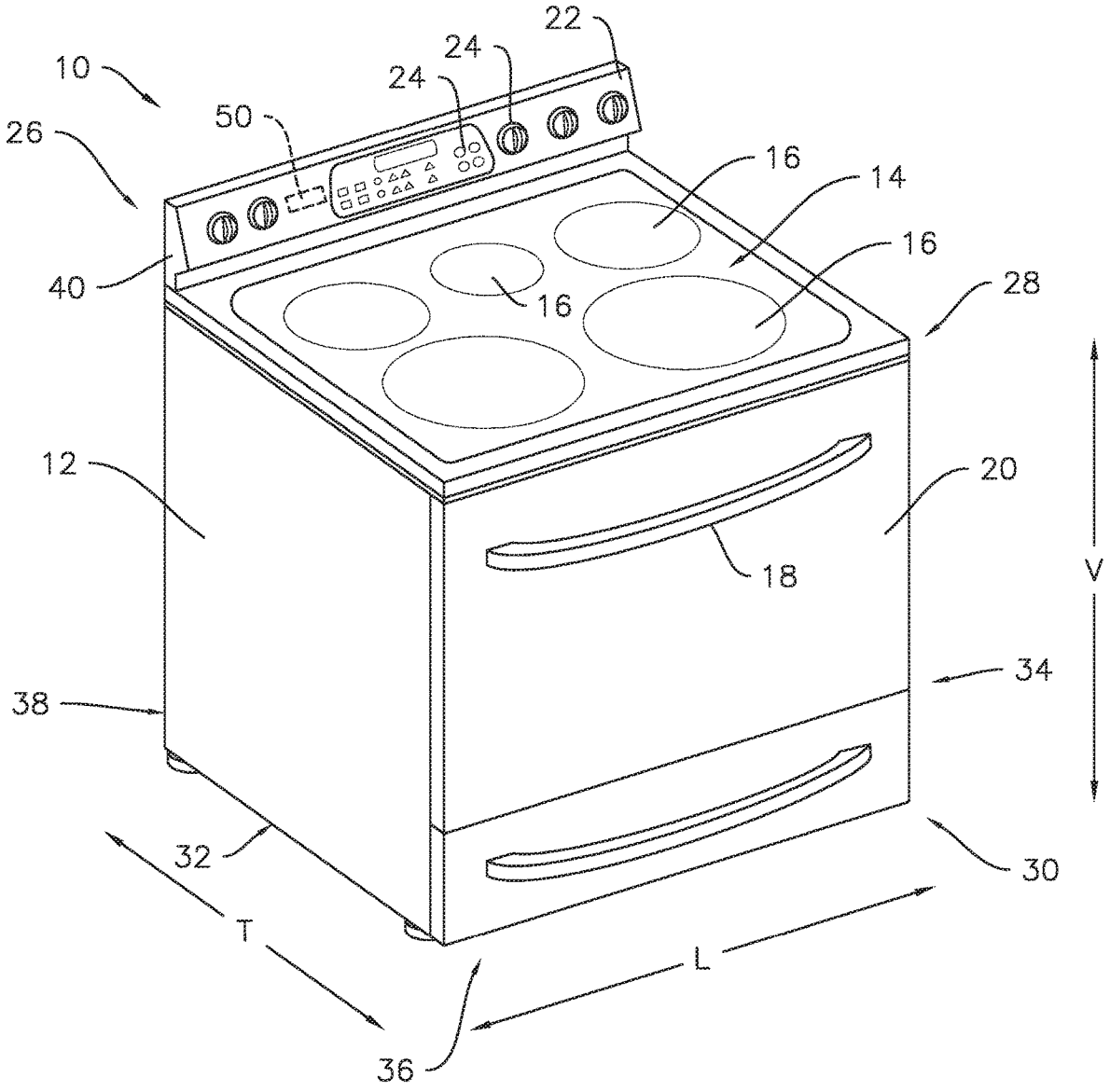
FIG. 1 provides a perspective view of an oven appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an oven appliance 10 according to an exemplary embodiment of the present subject matter. As may be seen, e.g., in FIGS. 1 and 2, oven appliance 10 defines a vertical direction V, a lateral direction L and a transverse direction T. The vertical direction V, the lateral direction L and the transverse direction T are mutually perpendicular and form an orthogonal direction system. Oven appliance 10 is provided by way of example only and is not intended to limit the present subject matter to the arrangement shown in FIG. 1. Thus, the present subject matter may be used with other oven appliance configurations, e.g., double oven appliances, oven appliances having differently arranged burners, etc.

Figure 2:
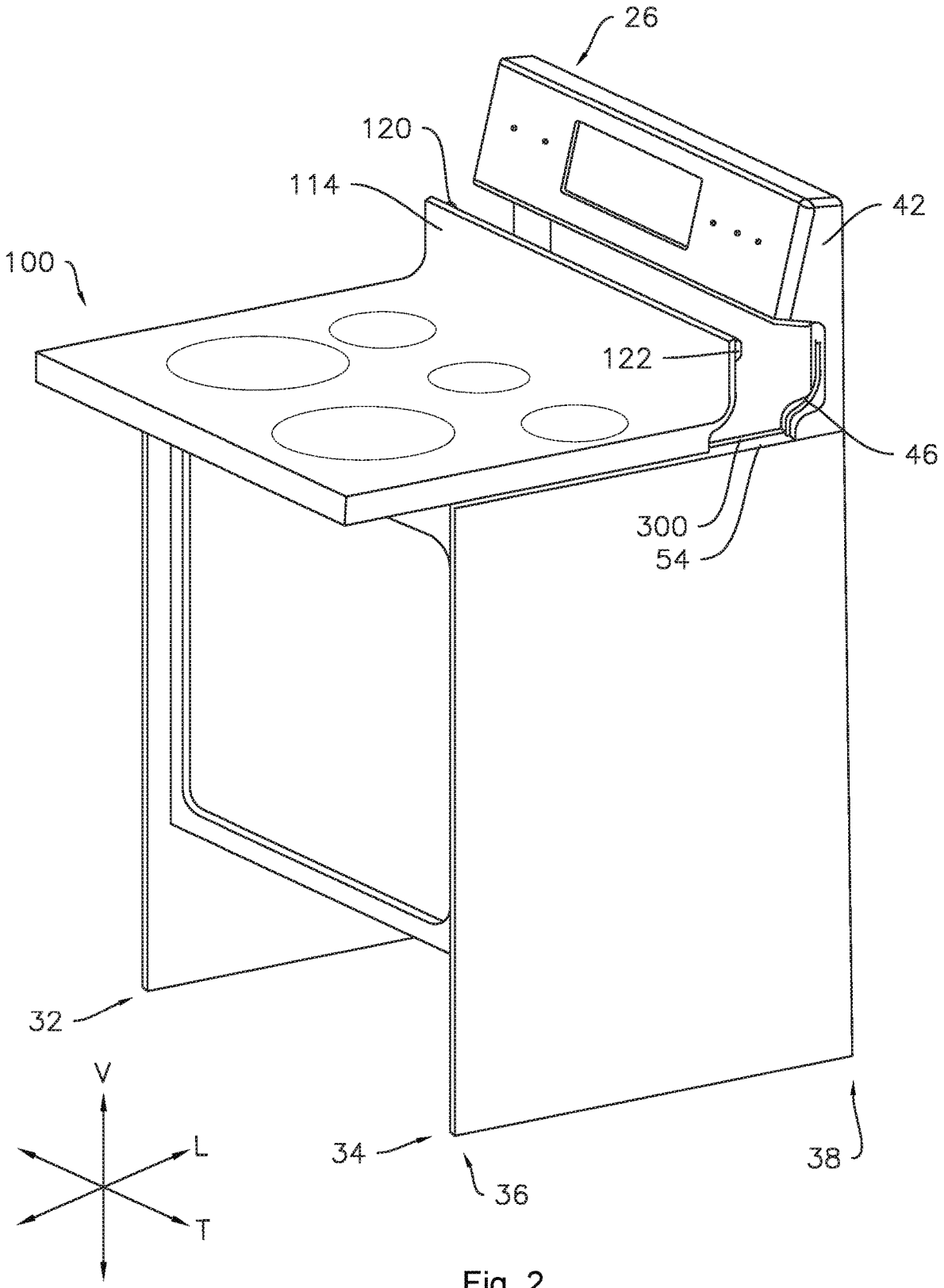
FIG. 2 provides a perspective view of the exemplary oven appliance of FIG. 1 in a partially assembled position or configuration.

As seen, e.g., in FIGS. 1 and 2, the oven appliance includes a housing or cabinet 12. The cabinet 12 extends between a top portion 28 and a bottom portion 30 along the vertical direction V, between a left side 32 and a right side 34 along the lateral direction L, and between a front portion 36 and a back portion 38 along the transverse direction T.

A cooking surface 14 may be provided at or near the top portion 28 of cabinet 12. The cooking surface 14 includes a plurality of heating elements 16 disposed within a maintop 100. As described in more detail below, the maintop 100 may be connected to the cabinet 12 at top portion 28. For the embodiment depicted, the oven appliance 10 includes five heating elements 16 spaced along cooking surface 14. The heating elements 16 may be electric heating elements. In certain exemplary embodiments, oven appliance 10 may be an induction appliance with induction heating elements or coils mounted below cooking surface 14. However, in other embodiments, the oven appliance 10 may include any other suitable shape, configuration, and/or number of heating elements 16. Additionally, in other embodiments, the oven appliance 10 may include any other suitable type of heating element 16, such as one or more gas burners or resistance heating elements. Each of the heating elements 16 may be the same type of heating element 16, or oven appliance 10 may include a combination of different types of heating elements 16.

Oven appliance 10 also includes a door 20 that permits access to a cooking chamber (not shown) defined within the cabinet 12 of oven appliance 10, e.g., for cooking or baking of food items therein. A handle 18 is mounted to door 20 and assists a user with opening and closing door 20. A control panel 22 having controls 24 permits a user to make selections for cooking of food items. The control panel 22 may be positioned on a backsplash 26 of oven appliance 10. As shown in FIGS. 1 and 2, the backsplash 26 of the oven appliance 10 may include a backsplash 114 of the maintop 100, a first end plate 40, and a second end plate 42. Controls 24 may include buttons, knobs, and the like, as well as combinations thereof. As an example, a user may manipulate one or more controls 24 to select a temperature and/or a heat or power output for each heating element 16.

The oven appliance 10 may include a controller 50 operably connected to the control panel 22 and controls 24. The controller 50 may be operably connected to each of the plurality of heating elements 16 for controlling a power level and/or heat level of each of the plurality of heating elements 16 in response to one or more user inputs received through the control panel 22 and controls 24. The controls 24 may be configured in wired or wireless communication with the controller 50. Signals generated in controller 50 operate appliance 10 in response to user input via the controls 24.

The controller 50 may generally include a computing device having one or more processor(s) and associated memory device(s). The computing device may be configured to perform a variety of computer-implemented functions to control the exemplary oven appliance 10. The computing device can include a general purpose computer or a special purpose computer, or any other suitable computing device. It should be appreciated, that as used herein, the processor may refer to a controller, a microcontroller, a microcomputer, a programmable logic controller (PLC), an application specific integrated circuit, and other programmable circuits. Additionally, the memory device(s) may generally comprise memory element(s) including, but not limited to, computer readable medium (e.g., random access memory (RAM)), computer readable non-volatile medium (e.g., a flash memory), a compact disc-read only memory (CD-ROM), a magneto-optical disk (MOD), a digital versatile disc (DVD), and/or other suitable memory elements. The memory can store information accessible by processor (s), including instructions that can be executed by processor (s). For example, the instructions can be software or any set of instructions that when executed by the processor(s), cause the processor(s) to perform operations. The instructions may include a software package configured to operate the oven appliance 10.

Further, the controller 50 is operably connected to each of the plurality of heating elements 16 for controlling a power level of each of the plurality of heating elements 16 in response to one or more user inputs through the controls 24. For example, in embodiments wherein one or more of the heating elements 16 are configured as electric resistance heaters, the controller 50 may be operably connected to respective relays, triodes for alternating current, or other devices for controlling an amount of power to such electrical resistance heaters. Alternatively, in embodiments wherein one or more of the heating elements 16 are configured as induction heating elements, the controller 50 may be operably connected to respective current control devices. As yet another example, in embodiments where the heating elements 16 are gas burners, the controller 50 may actuate one or more gas valves (not shown) to adjust a supply of gas to burners 16.

Figure 3:
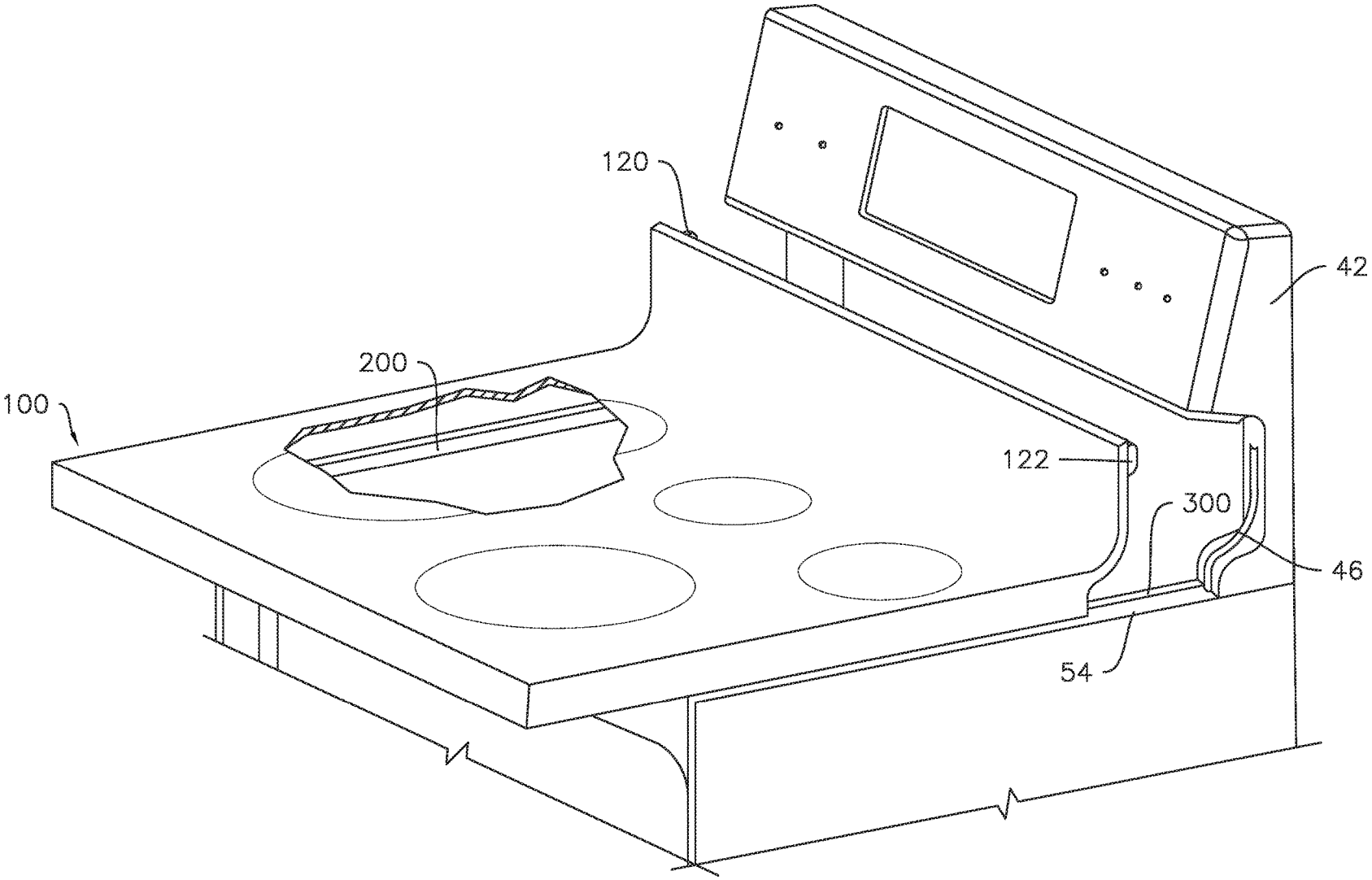
FIG. 3 provides an enlarged view of a portion of FIG. 2.

As illustrated for example in FIGS. 2 and 3, the oven appliance 10 may include a first brace 200 and a second brace 300 mounted to the cabinet 12 along the transverse direction T. The first brace 200 may be mounted to the cabinet 12 at the top portion 28 of the cabinet 12, when so mounted, the first brace 200 may extend along the left side 32 of the cabinet 12 between the front portion 36 of the cabinet 12 and the back portion 38 of the cabinet 12. The second brace 300 may be mounted to the cabinet 12 at the top portion 28 of the cabinet 12, when so mounted, the second brace 300 may extend along the right side 34 of the cabinet 12 between the front portion 36 of the cabinet 12 and the back portion 38 of the cabinet 12. In some embodiments, the first brace 200 and the second brace 300 may extend along all or substantially all of the depth of the cabinet 12, e.g., from the front portion 36 of the cabinet 12 to the back portion 38 of the cabinet 12. As used herein, "substantially" means at least ninety percent (90%). In other embodiments, the first brace 200 and the second brace 300 may extend along about three quarters of the depth of the cabinet 12, or about half of the depth of the cabinet 12, or about one quarter of the depth of the cabinet 12. As used herein, "about" means within ten percent of the stated value, e.g., "about three quarters" includes from sixty-five percent (65%) to eighty-five percent (85%). One of ordinary skill in the art will recognize that the first brace 200 and the second brace 300 may encompass any suitable sizes or dimensions to provide structural support and stability to the cabinet 12. Additionally, the first brace 200 may include a first emboss 202 extending along the vertical direction V, e.g., upward with respect to the remainder of the first brace 200 when the first brace 200 is mounted to the cabinet 12. Similarly, the second brace 300 may include a second emboss 302 extending along the vertical direction V, e.g., upward with respect to the remainder of the second brace 300 when the second brace 300 is mounted to the cabinet 12. During installation of the maintop 100 on the cabinet 12 as well as when the maintop 100 is fully installed and fixedly mounted to the cabinet 12, the maintop 100 may be constrained against movement along the lateral direction by the first emboss 202 and the second emboss 302. For example, the maintop 100 may be constrained against movement along the lateral direction L towards the right side 34 of the cabinet 12 by the first brace 200, e.g., by the first emboss 202, and constrained against movement along the lateral direction L towards the left side 32 of the cabinet 12 by the second brace 300, e.g., by the second emboss 302.

Figure 7:
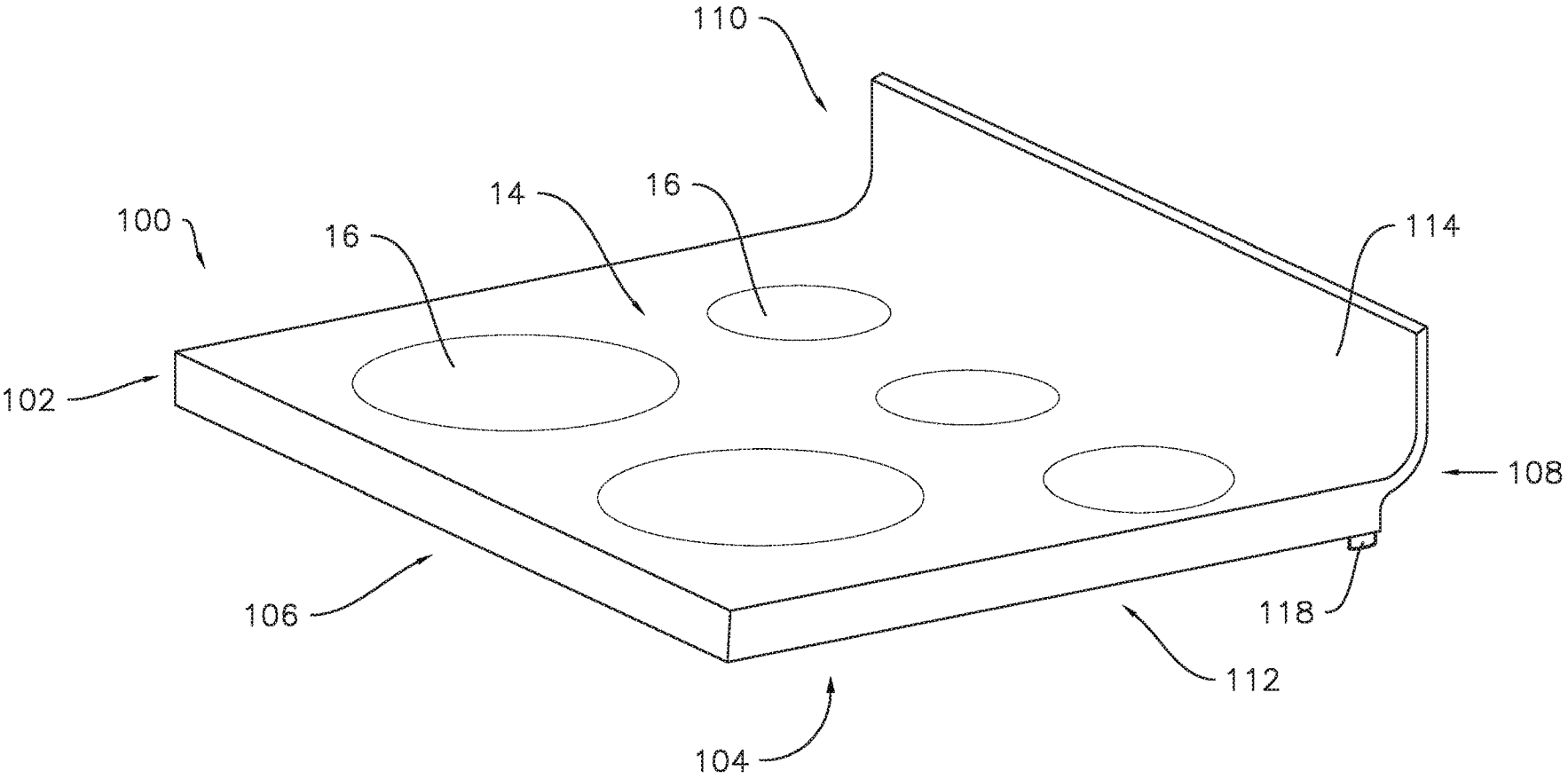
FIG. 7 provides a perspective view of a maintop in accordance with one or more exemplary embodiments of the present disclosure which may be incorporated in an oven appliance such as the exemplary oven appliance of FIG. 1.

As best shown in FIG. 7, the maintop 100 extends between a left side 102 and a right side 104 along the lateral direction L. The maintop 100 also extends between a front portion 106 and a back portion 108 along the transverse direction T and between a top portion 110 and a bottom portion 112 along the vertical direction V. The maintop 100 also includes a backsplash 114 which extends along the vertical direction V at the back portion 108 of the maintop 100. As illustrated, the backsplash 114 of the maintop 100 provides a continuous surface with the cooking surface 14, which may prevent or reduce spills, splatters, etc. of food items during cooking travelling into an interior of the cabinet 12.

Figure 4:
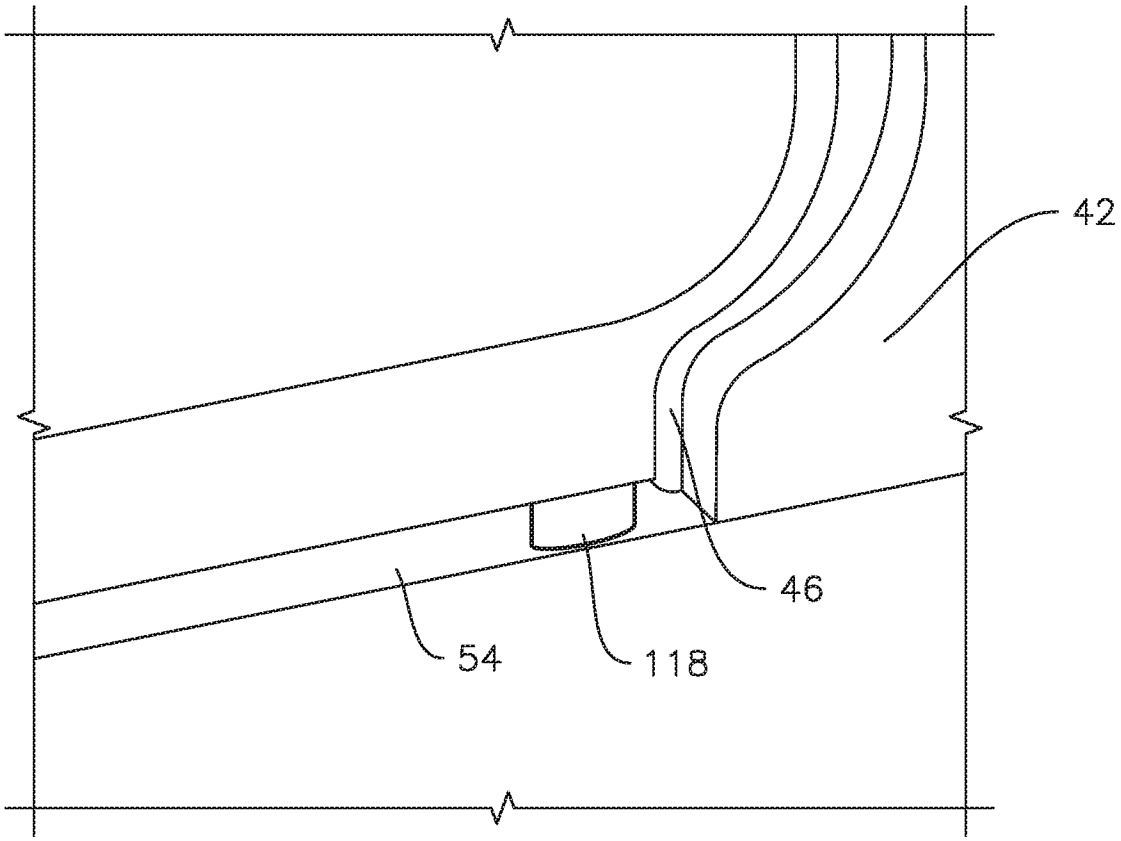
FIG. 4 provides a perspective view of a portion of the exemplary oven appliance of FIG. 1.
Figure 6:
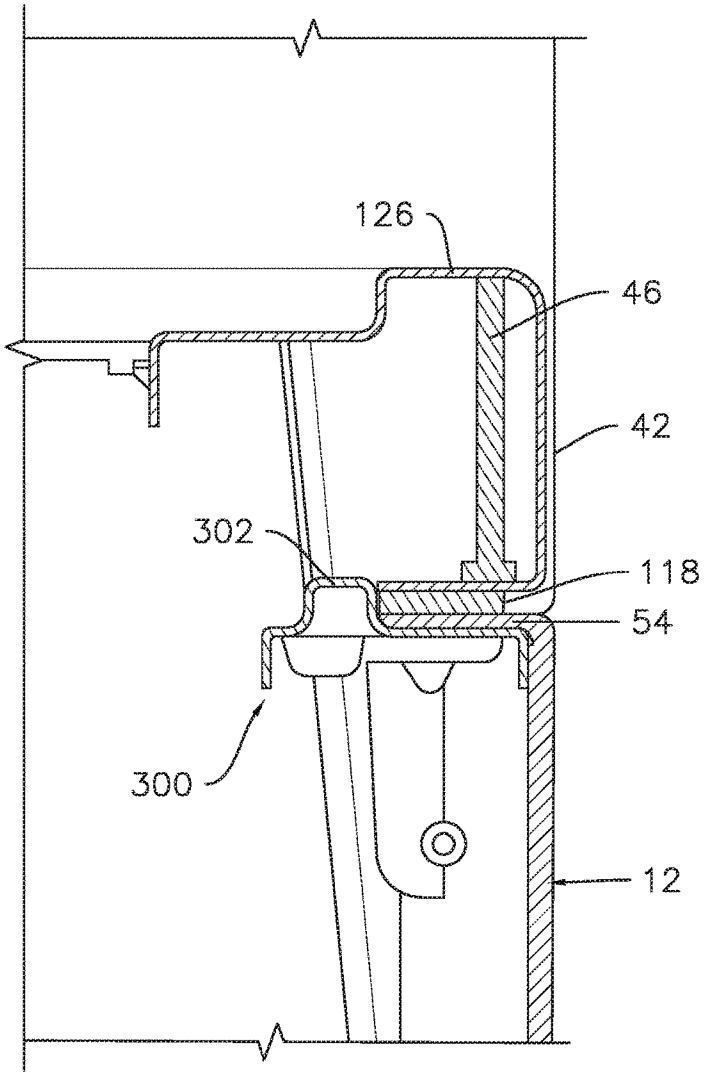
FIG. 6 provides a section view of a portion of the exemplary oven appliance of FIG. 1.
Figure 5:
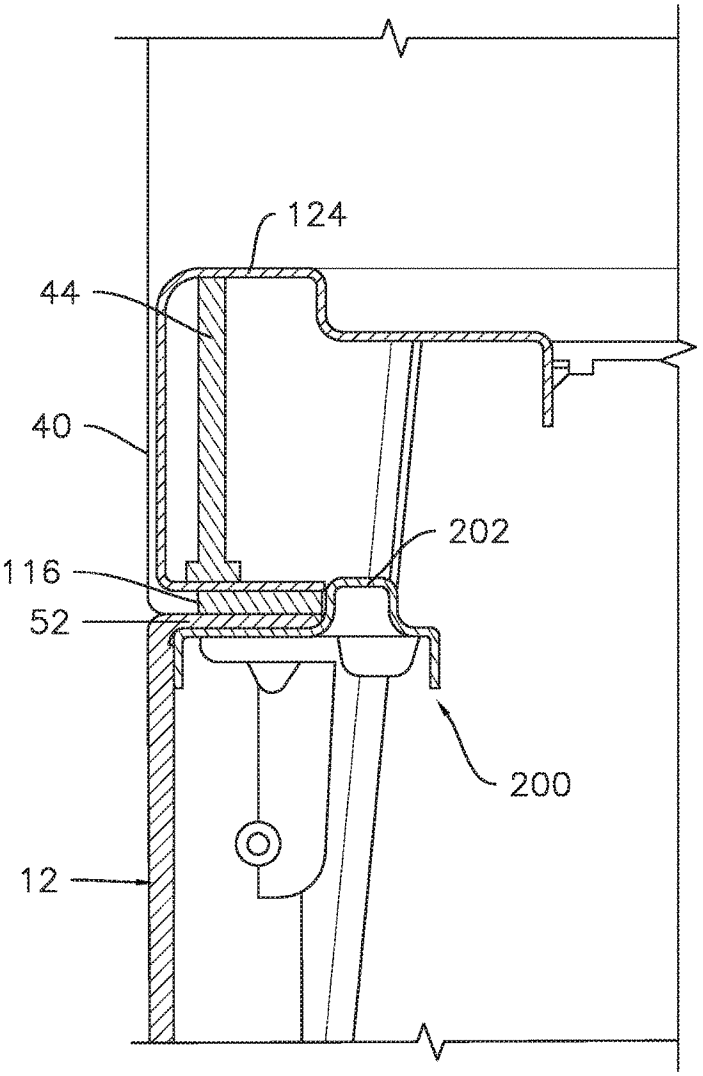
FIG. 5 provides a section view of a portion of the exemplary oven appliance of FIG. 1.

As may be seen in FIGS. 4-6, the maintop 100 further includes a first spacer 116 extending from the maintop 100 towards the cabinet 12 along the vertical direction V at the left side 102 of the maintop 100 and a second spacer 118 extending from the maintop 100 towards the cabinet 12 along the vertical direction V at the right side 104 of the maintop 100. The first and second spacers 116 and 118 provide vertical positioning of maintop 100 relative to cabinet 12, e.g., the first and second spacers 116 and 118 may provide a desired vertical separation between the maintop 100 and the cabinet 12 with the maintop 100 above the cabinet 12 along the vertical direction V. As shown in FIG. 5, the first spacer 116 of the maintop 100 engages the first emboss 202 of the first brace 200. As shown in FIG. 6, the second spacer 118 of the maintop 100 engages the second emboss 302 of the second brace 300.

Also illustrated in FIG. 5 is a left flange 52 of the cabinet 12 disposed along the left side 32 of the cabinet 12 at the top portion 28 of the cabinet 12. The first brace 200 may be mounted to the cabinet 12 below the left flange 52 with a generally flat top surface 204 (FIG. 8) of the first brace 200 flush with the left flange 52 whereby the emboss 202 of the first brace 200 extends above the left flange 52 along the vertical direction V. As may be seen in FIG. 6, a right flange 54 may be disposed along the right side 34 of the cabinet 12 at the top portion 28 of the cabinet 12. The second brace 300 may be mounted to the cabinet below the right flange 54 with a generally flat top surface 304 (FIG. 8) of the second brace 300 flush with the right flange 54 whereby the second emboss 302 of the second brace 300 extends above the right flange 54 along the vertical direction V.

As illustrated for example in FIGS. 5 and 6, the maintop 100 may be mounted to the cabinet 12 above the left flange 52 and the right flange 54. The flanges 52 and 54 may be generally perpendicular to the sides of the cabinet 12 from which they extend, e.g., the flanges 52 and 54 may turn inward towards the interior of the cabinet 12 along the lateral direction L. Also, the flanges 52 and 54 may extend substantially across the entire depth of the cabinet 12, e.g., from the back portion 38 to the front portion 36. In other embodiments, the flanges 52 and 54 may extend across about one half of the depth of the cabinet 12, e.g., at a rear half of the cabinet 12 proximate back portion 38 or a central half of the cabinet 12 equidistant from the front portion 36 and the back portion 38. In additional exemplary embodiments, the flanges 52 and 54 may extend across about one third or about one quarter of the depth of the cabinet 12. During assembly of the oven appliance 10 and installation of the maintop 100 on the cabinet 12, the maintop 100 may be slid into place along the transverse direction T, e.g., into the position illustrated in FIG. 1 while passing through the position illustrated in FIG. 2. During such installation, the spacers 116 and 118 engage the embosses 202 and 302, respectively, as described above. Moreover, such engagement between the spacers 116 and 118 and the embosses 202 and 302 may advantageously provide or maintain a desired alignment of the maintop 100 and the cabinet 12 during installation of the maintop 100 on the cabinet 12. Thus, the maintop 100 may be automatically aligned or self-aligned with the cabinet 12. Additionally, installing the maintop 100 on the cabinet 12 by sliding the maintop 100 on as described herein may advantageously reduce the number of parts required in the oven appliance 10. For example, the oven appliance 10 may not include any hinge pins connecting the maintop 100 to the cabinet 12.

In addition to laterally engaging the embosses 202 and 302, the spacers 116 and 118 contact and slide along the left flange 52 and the right flange 54 of the cabinet 12. Accordingly, the first spacer 116 and the second spacer 118 advantageously comprise a durable and low-friction material. For example, the first spacer 116 and the second spacer 118 may comprise a low-friction plastic material, such as nylon. In various embodiments, the first and second spacer 116 and 118 may comprise any suitable low-friction material, e.g., a material having a coefficient of friction of about 0.5 or less, such as a coefficient of friction of about 0.3 or less, such as a coefficient of friction of about 0.25 or less, such as a coefficient of friction of about 0.1 or less, such as a coefficient of friction of about 0.05. In various embodiments, the spacers 116 and 118 may comprise any suitable material which provides the aforementioned structural strength for supporting the maintop 100 above the cabinet 12 and low friction to permit the maintop 100 to slide along the cabinet 12.

The spacers 116 and 118 may be unitary with the maintop 100, e.g., the maintop 100 may be formed of sheet metal and the spacers 116 and 118 may each comprise an emboss in the sheet metal maintop 100. In some embodiments where the spacers 116 and 118 comprise embosses on the maintop 100, the spacers 116 and 118 may include a coating of a low-friction material, e.g., nylon as described above or an enamel, etc., provided on each emboss. In other embodiments, the spacers 116 and 118 may be separately formed pieces which are joined to the maintop 100. For example, the maintop 100 may be formed of sheet metal and the spacers 116 and 118 may each comprise a separate piece of material, e.g., nylon, which is joined to the maintop 100, such as by a press fit, with a fastener, or any other suitable manner of joining.

As mentioned above, the oven appliance 10 may include a backsplash 26. In the illustrated embodiment, the backsplash 26 includes the backsplash 114 of the maintop, the first and second end plates 40 and 42, and a back panel (not shown) of the cabinet 12. A third spacer 120 and a fourth spacer 122 may be provided on the backsplash 114 of the maintop 100. In the installed position, the third spacer 120 may extend from the backsplash 114 of the maintop 100 along the transverse direction T and may abut the first end plate 40 to prevent contact between the maintop 100 and the first end plate 40. Also in the installed position, the fourth spacer 122 may extend from the backsplash 114 of the maintop 100 along the transverse direction T and may abut the second end plate 42 to prevent contact between the maintop 100 and the second end plate 42. The third and fourth spacers 120 and 122 may be unitary with the backsplash 114 of the maintop 100, e.g., may be embosses similar to the first and second spacers 116 and 118 described above. The third and fourth spacers 120 and 122 may also be separately formed and joined to the backsplash 114, similar to the first and second spacers 116 and 118 described above. For example, the third and fourth spacers 120 and 122 may comprise a plastic material, a rubber or elastomer material, or any other suitable material. In additional embodiments, the third and fourth spacers 120 and 122 may be connected to the first and second end plates 40 and 42. For example, the third and fourth spacers 120 and 122 may be embosses on the first and second end plates 40 and 42, or may be separate pieces joined to the first and second end plates 40 and 42.

As shown in FIGS. 4 through 6, the first end plate 40 may extend along the left side 32 of the cabinet 12 from the back portion 38 of the cabinet 12, e.g., along the transverse direction T. The first end plate 40 may also include a tongue 44 which may, in the installed position, be received within a first channel 124 of the maintop 100, as shown in FIG. 5. As shown in FIGS. 4 through 6, the second end plate 42 may extend along the right side 34 of the cabinet 12 from the back portion 38 of the cabinet 12, e.g., along the transverse direction T. As illustrated in FIGS. 4 and 6, the second end plate 42 may include a tongue 46 which may, in the installed position, be received within a second channel 126 of the maintop 100. Receipt of the tongues 44 and 46 within the channels 124 and 126, respectively, may advantageously constrain or limit movement of the maintop 100 along the vertical direction V, e.g., upward, with respect to the cabinet 12.

Figure 8:
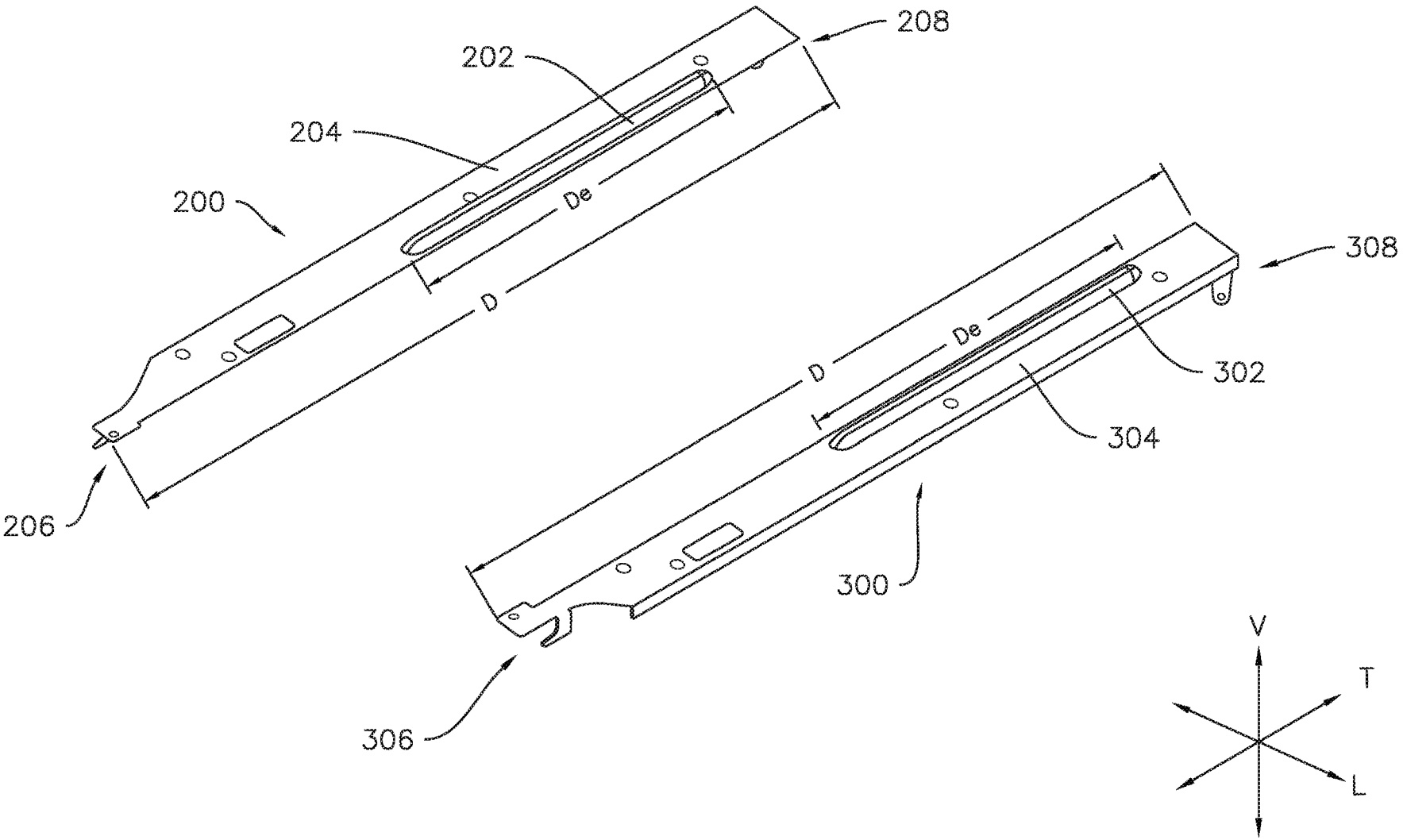
FIG. 8 provides a perspective view of a first brace and a second brace in accordance with one or more exemplary embodiments of the present disclosure which may be incorporated in an oven appliance such as the exemplary oven appliance of FIG. 1.

FIG. 8 provides a perspective view of a first brace 200 and a second brace 300, where the first brace 200 and second brace 300 are depicted generally in an orientation corresponding to the installed position. As shown, the first brace 200 extends between a front portion 206 and a back portion 208 along the transverse direction T and the second brace 300 also extends between a front portion 306 and a back portion 308 along the transverse direction T. Accordingly, each of the first brace 200 and the second brace 300 defines a depth D along the transverse direction T when installed in the oven appliance 10. As mentioned above, the first brace 200 and the second brace 300 may, in some embodiments, extend along all or substantially all (e.g., about 90% or more) of the depth of the cabinet 12. Accordingly, the back portion 208 of the first brace 200 may be secured, e.g., fastened with a fastener such as a screw or rivet, to the back portion 38 of the cabinet 12 and the back portion 308 of the second brace 300 may be similarly secured to the back portion 38 of the cabinet 12. The front portion 206 of the first brace 200 and the front portion 306 of the second brace 300 may each be secured to the front portion 36 of the cabinet 12. In various embodiments, the first brace 200 and the second brace 300 may be secured to the cabinet near the front and back portions 36 and 38, respectively, of the cabinet 12 instead of or in addition to being secured directly to the front portion 36 and back portion 38. For example, the front portion 206 of the first brace 200 and the front portion 306 of the second brace 300 may each be secured to the top portion 28 of the cabinet 12 at or near a top front edge of the cabinet defined by a junction of the top portion 28 with the front portion 36. Accordingly, the depth D may be substantially equivalent to the depth of the cabinet 12 such that the first brace 200 and the second brace 300 may extend along the transverse direction T from the front portion 36 of the cabinet 12 to the back portion 38 of the cabinet 12. In various embodiments, the first brace 200 and the second brace 300 may be secured to the cabinet 12 by any of several means, such as fasteners, welding, press-joining, or any other suitable method or combination of methods.

Also shown in FIG. 8, the first emboss 202 and the second emboss 302 each define a depth $D_E$ along the transverse direction T. The depth $D_E$ of each emboss 202, 302 is generally less than the depth D of the corresponding brace 200, 300. For example, the embosses 202 and 302 generally may not extend to the back portions 208 and 308 of the braces 200 and 300, such that the embosses 202 and 302 each terminate short of the backsplash 26 (e.g., FIG. 1), and in particular the end plates 40 and 42 of the backsplash 26. Additionally, the alignment of the maintop 100 (e.g., FIGS. 2 and 3) with the cabinet 12 provided by the interaction of the embosses 202 and 302 with the maintop 100 may be most advantageous when the maintop 100 is close to the fully installed position (shown, e.g., FIG. 1). Accordingly, the embosses 202 and 302 may not extend fully to the front portions 206 and 306. For example, in some embodiments, the depth $D_E$ of the embosses 202 and 302 may correspond to about half of the transverse distance along which the maintop 100 slides when the maintop 100 is installed on the cabinet 12, e.g., the last half or other portion of the transverse sliding distance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a lateral direction, a transverse direction, and a vertical direction, the lateral direction, the transverse direction, and the vertical direction are mutually perpendicular, the oven appliance comprising:

a cabinet extending between a top portion and a bottom portion along the vertical direction, between a left side and a right side along the lateral direction, and between a front portion and a back portion along the transverse direction;

a first brace mounted to the cabinet at the top portion of the cabinet and extending along the left side of the cabinet between the front portion of the cabinet and the back portion of the cabinet, the first brace comprising a first emboss extending along the vertical direction;

a second brace mounted to the cabinet at the top portion of the cabinet and extending along the right side of the cabinet between the front portion of the cabinet and the back portion of the cabinet, the second brace comprising a second emboss extending along the vertical direction; and a maintop fixedly mounted on the top portion of the cabinet, the maintop extending between a left side and a right side along the lateral direction, the maintop comprising a first spacer extending from the maintop towards the cabinet along the vertical direction at the left side of the maintop and a second spacer extending from the maintop towards the cabinet along the vertical direction at the right side of the maintop, the first spacer of the maintop engages the first emboss of the first brace, and the second spacer of the maintop engages the second emboss of the second brace, and the maintop constrained against movement along the lateral direction towards the right side of the cabinet by the first brace and constrained against movement along the lateral direction towards the left side of the cabinet by the second brace.

2. The oven appliance of claim 1, wherein the maintop is constrained against movement along the lateral direction by the first emboss and the second emboss.

3. The oven appliance of claim 1, wherein the first spacer and the second spacer each comprise a low-friction material.

4. The oven appliance of claim 1, further comprising a first end plate extending along the left side of the cabinet from the back portion of the cabinet, a tongue of the first end plate received within a first channel of the maintop, a second end plate extending along the right side of the cabinet from the back portion of the cabinet, and a tongue of the second end plate received within a second channel of the maintop.

5. The oven appliance of claim 4, wherein the maintop comprises a backsplash, the oven appliance further comprising a spacer extending from the backsplash along the transverse direction, the spacer abutting one of the first end plate and the second end plate.

6. The oven appliance of claim 1, wherein the cabinet comprises a left flange along the left side of the cabinet at the top portion of the cabinet and a right flange along the right side of the cabinet at the top portion of the cabinet, the first brace mounted to the cabinet below the left flange, the second brace mounted to the cabinet below the right flange, and the maintop mounted to the cabinet above the left flange and the right flange.

7. The oven appliance of claim 1, further comprising a heating element positioned within the maintop.

8. The oven appliance of claim 7, wherein the heating element is an electric heating element.

9. An oven appliance, comprising:

a cabinet extending between a top portion and a bottom portion along a vertical direction and extending between a left side and a right side along a lateral direction, the vertical direction and the lateral direction are mutually perpendicular, the cabinet comprising a left flange along the left side of the cabinet at the top portion of the cabinet and a right flange along the right side of the cabinet at the top portion of the cabinet; and a maintop having a heating element positioned within the maintop, the maintop fixedly mounted to the top portion of the cabinet, the maintop constrained against movement along the lateral direction by a first emboss formed on a first brace at the left side of the cabinet and a second emboss formed on a second brace at the right side of the cabinet, the first brace mounted to the cabinet below the left flange, the second brace mounted to the cabinet below the right flange, and the maintop mounted to the cabinet above the left flange and the right flange.

10. The oven appliance of claim 9, wherein the first brace is mounted to the left side of the cabinet and the second brace is mounted to the right side of the cabinet.

11. The oven appliance of claim 9, wherein the maintop extends between a left side and a right side along the lateral direction, the maintop further comprising a first spacer extending from the maintop towards the cabinet along the vertical direction at the left side of the maintop and a second spacer extending from the maintop towards the cabinet along the vertical direction at the right side of the maintop.

12. The oven appliance of claim 11, wherein the first spacer of the maintop engages the first emboss and the second spacer of the maintop engages the second emboss.

13. The oven appliance of claim 11, wherein the first spacer and the second spacer each comprise a low-friction material.

14. The oven appliance of claim 9, further comprising a control panel positioned above the top portion of the cabinet along the vertical direction, the control panel extending along the lateral direction between a first end plate at the left side of the cabinet and a second end plate at the right side of the cabinet, a tongue of the first end plate received within a first channel of the maintop, and a tongue of the second end plate received within a second channel of the maintop.

15. The oven appliance of claim 14, wherein the maintop comprises a backsplash, the oven appliance further comprising a spacer extending from the backsplash and abutting one of the first end plate and the second end plate.

16. The oven appliance of claim 9, wherein the heating element is an electric heating element.

* * * * *